US008444073B2

(12) United States Patent
Kawamoto et al.

(10) Patent No.: US 8,444,073 B2
(45) Date of Patent: May 21, 2013

(54) KNEADING APPARATUS AND METHOD FOR PRODUCING TONER

(75) Inventors: Masahiro Kawamoto, Shizuoka (JP); Tetsuya Tanaka, Shizuoka (JP); Kenta Kenjoh, Shizuoka (JP); Satoshi Izumi, Shizuoka (JP); Ippei Muneoka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 201 days.

(21) Appl. No.: 12/967,726

(22) Filed: Dec. 14, 2010

(65) Prior Publication Data

US 2011/0139909 A1 Jun. 16, 2011

(30) Foreign Application Priority Data

Dec. 16, 2009 (JP) ..... 2009-285350

(51) Int. Cl.
*B02C 21/00* (2006.01)
*B02C 19/00* (2006.01)
*B02C 13/10* (2006.01)

(52) U.S. Cl.
USPC ..... 241/67; 241/152.2; 241/163

(58) Field of Classification Search
USPC ..... 241/67, 163, 161, 152, 152.2
See application file for complete search history.

(56) References Cited

U.S. PATENT DOCUMENTS 1,141,898 A * 6/1915 Merritt ..... 241/67
1,851,071 A * 3/1932 Travis ..... 241/245
2,402,170 A * 6/1946 Lund ..... 241/66
2,972,473 A * 2/1961 Heller ..... 241/152.1
3,398,900 A * 8/1968 Sweeney et al. ..... 241/67
3,971,514 A * 7/1976 Martinelli et al. ..... 241/82.4
4,174,074 A * 11/1979 Geiger ..... 241/46.11
5,921,480 A * 7/1999 Wenzel ..... 241/29

FOREIGN PATENT DOCUMENTS

| | | |
|---|---|---|
| JP | 52-148868 | 12/1977 |
| JP | 54-24743 | 8/1979 |
| JP | 2-92 | 1/1990 |
| JP | 11-19925 | 1/1999 |
| JP | 2007-94346 | 4/2007 |
| JP | 3950648 | 4/2007 |
| JP | 4085125 | 2/2008 |

* cited by examiner

*Primary Examiner* — Faye Francis
(74) *Attorney, Agent, or Firm* — Oblon, Spivak, McClelland, Maier & Neustadt, L.L.P.

(57) ABSTRACT

A continuous kneading apparatus including: a stationary portion having an internal space where matter is conveyed; a rotary disc member and a screw member which are configured to convey the matter in the internal space; a drive shaft member to which the rotary disc member and the screw member are fixed; and a cooling medium passage through which a cooling medium passes, wherein the cooling medium passage is provided for the screw member which is placed upstream of the rotary disc member with respect to the conveyance direction of the matter, wherein the cooling medium passing in the cooling medium passage is lower in temperature than the matter passing in the internal space, and wherein the matter passes in the internal space while provided with shear force by rotation of the drive shaft member and thus continuously kneaded, and while cooled by the cooling medium.

8 Claims, 10 Drawing Sheets

KNEADING APPARATUS AND METHOD FOR PRODUCING TONER

BACKGROUND OF THE INVENTION

1. Field of the Invention

The present invention relates to a kneading apparatus for resin compounding, and a method for producing a toner for developing an electrostatic image, used in an electrophotographic image forming apparatus.

2. Description of the Related Art

The term "resin compounding" generally refers to kneading and dispersion of functional fillers for the purpose of imparting functions to resins serving as bases. Examples of the imparted functions include conductivity, charging property, magnetism, thermal conductivity, piezoelectricity, vibration suppressing property, sound insulating property, sliding property, heat insulating property, lightness, light scattering/reflecting property, heat ray radiating property, flame-retardant property, radiation protection, ultraviolet protection, dehydrating property, color generating property and releasing property.

Examples of the functional fillers include carbon black, graphite, ferrite, magnetic iron oxide, alumina, barium titanate, lead zirconate titanate, mica, potassium titanate, xonotlite, carbon fibers, lead powder, barium sulfate, molybdenum sulfide, Teflon (registered trademark) powder, talc, glass balloons, Shirasu balloons, charcoal powder, titanium oxide, glass beads, calcium carbonate, aluminum powder, magnesium oxide, hydrotalcite, dawsonite, zinc oxide, iron oxide, calcium oxide, magnesium oxide, pigments and waxes.

Specific examples of applied products of the resin compounding include an electrostatic image developing toner obtained by dispersing a pigment, a wax, a charge controlling agent, etc. in a resin, a pigment masterbatch obtained by dispersing a pigment in a resin, a flame-retardant plastic obtained by dispersing a flame retardant in a resin, and a foaming agent masterbatch obtained by dispersing a foaming agent in a resin (refer to p. 337, "Base technology and High technology applications of Mixing & Dispersion", published by Techno System).

Resin compounding methods for kneading and dispersing functional fillers are broadly classified into the batch kneading method and the continuous kneading method. The batch kneading method is problematic in that the kneading temperature is difficult to control and so the quality easily varies from batch to batch, and also problematic in that long-time operation is required, which leads to low throughput and low productivity. Due to such problems with the batch kneading method, the continuous kneading method is becoming popular as a present-day resin compounding method.

The most typical kneading apparatus for use in the continuous kneading method (hereinafter referred to also as "continuous kneading apparatus") would be the biaxial-screw continuous kneading apparatus in which shear force generated between two screws that are disposed parallel and close to each other is applied to a heated and melted resin so as to knead and disperse functional fillers into the base resin.

However, regarding the present-day resin compounding, there is an increasing need for fine dispersion of fillers to improve functionalities further. In order for a biaxial-screw continuous kneading apparatus to meet this need, it is necessary to extend the apparatus in an axis direction to thereby increase an effective kneading area. This is because the effective kneading area is an area where the two screws are close to each other and thus, in order to meet the need for fine dispersion of the fillers, it is necessary to extend, as the kneading area, the area where the two screws are close to each other. When the apparatus is extended in an axis direction, however, there are problems such as an increase in the size of the apparatus and an increase in costs.

To meet the need for fine dispersion of the fillers in the present-day resin compounding, note is taken of stone mortar type continuous kneading apparatuses (refer to Japanese Patent Application Publication (JP-B) Nos. 02-000092 and 54-024743 and Japanese Patent Application Laid-Open (JP-A) No. 52-148868). The following explains a stone mortar type continuous kneading apparatus.

A stone mortar type continuous kneading apparatus includes a cylindrical stationary portion provided with an internal space through which a heated and melted resin can pass, and also includes a rotary portion which is placed in the internal space of the stationary portion and rotates thereby continuously kneading the resin passing through the internal space and, while doing so, conveying the resin in the rotational axis direction. The stationary portion is provided with an annular stationary disc placed such that the diameter of the internal space partially decreases, and the rotary portion is provided with a drive shaft member to which drive is transmitted from a drive source, and a rotary disc member fixed to the drive shaft member with its disc center penetrated by the drive shaft member. The rotary disc member is placed such that its circular surface faces the annular surface of the stationary disc, the surface of the rotary disc member and the surface of the stationary disc facing each other are provided with concave portions and convex portions shaped like mountains and valleys, and the rotary disc member and the stationary disc constitute a kneading area in the form of a stone mortar. By the rotary disc member rotating with respect to the stationary disc, the resin present in the gap between the rotary disc member and the stationary disc is subjected to shearing and thus kneaded and dispersed, while being moved, as in the case of a stone mortar. In such a stone mortar type continuous kneading apparatus, the kneading area is formed in a direction perpendicular to the rotational axis direction, so that it can perform kneading more efficiently than the biaxial-screw continuous kneading apparatus in which the area where the two screws are close to each other functions as the kneading area. Hence, the stone mortar type continuous kneading apparatus does not necessitate increasing the length thereof with respect to the axis direction in meeting the need for fine dispersion of the fillers, and thus fine dispersion of the fillers can be realized with a compact, low-priced apparatus in comparison with the biaxial-screw continuous kneading apparatus.

Nowadays, there is a need for finer dispersion of the fillers, and even the stone mortar type continuous kneading apparatuses cannot sufficiently meet the need in some cases.

In a stone mortar type continuous kneading apparatus, shear force acts on a resin present in the gap between a rotary disc member and a stationary disc; when the temperature of the resin present in the gap is too high, the viscosity of the heated and melted resin decreases, thereby making it difficult for the shear force to act effectively and thus making finer dispersion of the fillers difficult.

In the continuous kneading apparatus described in JP-B No. 02-000092, a stationary portion is provided with a cooling medium passage through which a cooling medium that is lower in temperature than a resin to be kneaded passes, but a rotary portion is not provided with a cooling medium passage, and thus it is not possible to cool the resin to a temperature suitable for shear force to act effectively in a kneading area.

Meanwhile, in each of the continuous kneading apparatuses described in JP-A No. 52-148868 and JP-B No.

54-024743, cooling passages are provided for a drive shaft member and a rotary disc member fixed to the drive shaft member, with the drive shaft member and the rotary disc member constituting a rotary portion. Thus, it is possible to make the temperature of a resin to closer to a temperature suitable for shear force to act in a kneading area than in the case of the continuous kneading apparatus described in JP-B No. 02-000092. However, it has turned out that the structure in which a cooling medium is passed through the drive shaft member and the rotary disc member yields poor resin cooling efficiency. The following is the reason for this.

Regarding the rotary portion in each of the continuous kneading apparatuses described in JP-A No. 52-148868 and JP-B No. 54-024743, it is desirable, for maintenance purposes, that a member which comes into contact with the resin to be kneaded be produced as a member different from the drive shaft member and that the member which comes into contact with the resin be fixed to the drive shaft member. Specifically, there is desirably a structure in which a screw member that comes into contact with the resin on the upstream side of the rotary disc member with respect to the conveyance direction of the resin and that rotates, thereby providing the resin with conveyance force advancing in the rotational axis direction, and the rotary disc member are produced as members different from the drive shaft member, and the screw member and the rotary disc member are fixed to the drive shaft member.

Coming into contact with the resin, the screw member and the rotary disc member could be temporally abraded or chipped owing to a temporary load, and so they need to have replaceable structures. Also, unless the screw member and the rotary disc member are separable from the drive shaft member, the entire rotary portion needs replacing when abrasion or chipping has arisen, thereby leading to an increase in running costs. In the case where the screw member and the rotary disc member are members different from the drive shaft member and are separable from the drive shaft member, only an abraded or chipped member can be replaced when abrasion or chipping has arisen, thereby making it possible to reduce running costs. Furthermore, replacement with a screw member having a different shape and/or a rotary disc member having a different shape makes it easily possible to alter conveyance conditions and/or kneading conditions to some extent and thus to yield a structure suitable for maintenance.

In the case where the screw member and the drive shaft member are different members, the heat transmission efficiency between the screw member and the drive shaft member is poor, and the resin positioned in contact with the screw member is poorly cooled even when a cooling medium is passed inside the drive shaft member.

In the kneading area, the resin increases in temperature by frictional heat generated when the shear force acts, and the increase in temperature can be suppressed by passing a cooling medium inside the rotary disc member; note that cooling can be performed more efficiently by a cooling medium performing a cooling function before the temperature increase in the kneading area. However, as described above, a cooling function does not easily work in the position in contact with the screw member, where the resin passes before increasing in temperature in the kneading area; therefore, the structure in which the cooling medium is passed through the drive shaft member and the rotary disc member yields poor resin cooling efficiency.

When the resin cooling efficiency is poor, the temperature of the resin to be supplied into the kneading area cannot be sufficiently lowered, shear force cannot be adequately applied to the resin, and thus finer dispersion of the fillers is impossible to achieve.

Also, in a process of producing an electrophotographic toner, if fine dispersion of fillers into a resin serving as a base is insufficient in a kneading step in which toner materials are melted and mixed together using a continuous kneading apparatus, it may be impossible to exhibit the functions required for the toner at the time of image formation, which could lead to a decrease in image quality.

The present invention is primarily aimed at solving the problems in related art and achieving the following objects.

A first object of the present invention is to provide a continuous kneading apparatus capable of efficiently cooling matter to be kneaded, and applying adequate shear force to the matter.

A second object of the present invention is to provide a method for producing a toner, capable of obtaining a toner wherein filler(s) is/are dispersed sufficiently finely in resin(s) serving as a base.

BRIEF SUMMARY OF THE INVENTION

Means for solving the problems are as follows.

<1> A continuous kneading apparatus which continuously kneads matter to be kneaded, including: a cylindrical stationary portion having an internal space in which the matter is conveyed; a rotary disc member configured to convey the matter in the internal space; a screw member configured to convey the matter in the internal space; a drive shaft member to which the rotary disc member and the screw member are fixed; and a cooling medium passage through which a cooling medium for cooling the matter passes, wherein the cooling medium passage is provided for the screw member which is placed upstream of the rotary disc member with respect to the conveyance direction of the matter, wherein the cooling medium passing in the cooling medium passage is lower in temperature than the matter passing in the internal space, and wherein the matter passes in the internal space while provided with shear force in an area, where an internal wall of the stationary portion and a circular surface of the rotary disc member face each other, by rotation of the drive shaft member and thus continuously kneaded, and while cooled by the cooling medium.

<2> The continuous kneading apparatus according to <1>, wherein the circular surface of the rotary disc member, and a surface of the internal wall of the stationary portion, faced by the circular surface, have a concavo-convex shape to provide shear force to the matter to be kneaded which passes through a gap between these surfaces.

<3> The continuous kneading apparatus according to <1> or <2>, wherein the stationary portion includes an annular stationary disc which forms the surface of the internal wall facing the circular surface of the rotary disc member.

<4> The continuous kneading apparatus according to any one of <1> to <3>, further including a cooling medium passage which is provided for the rotary disc member, and through which the cooling medium passes, wherein the cooling medium passage provided for the screw member and the cooling medium passage provided for the rotary disc member are adjacent to each other and communicate with each other, constituting a flow path.

<5> The continuous kneading apparatus according to any one of <1> to <4>, further including: an insertion port which is provided in an end of the internal space of the stationary portion on the upstream side with respect to the conveyance direction, and through which the matter to be kneaded is inserted into the internal space; and two screws, whose rotational axes are parallel to each other, as upstream-side conveyance members which convey the matter inserted from the insertion port into an area where the screw member provides conveyance force.

<6> The continuous kneading apparatus according to any one of <1> to <5>, wherein the minimum clearance between the circular surface of the rotary disc member, and the surface of the internal wall of the stationary portion, faced by the circular surface, is in the range of 0.2 mm to 5.0 mm.

<7> The continuous kneading apparatus according to any one of <1> to <6>, wherein the rotary disc member is placed in a plurality of places in relation to the drive shaft member with respect to the rotational axis direction, and the screw member provided with the cooling medium passage is placed upstream of each of the rotary disc members.

<8> The continuous kneading apparatus according to any one of <1> to <7>, further including: a cooling medium temperature adjusting unit configured to adjust the temperature of the cooling medium to a predetermined temperature; and a cooling medium passage provided in the drive shaft member, wherein the cooling medium, whose temperature has been adjusted by the cooling medium temperature adjusting unit, passes through the cooling medium passage provided for the screw member, then passes through the cooling medium passage provided in the drive shaft member, and subsequently returns to the cooling medium temperature adjusting unit.

<9> A method for producing a toner, including: weighing toner raw materials which include at least a resin; heating and melting the toner raw materials weighed in the weighing, so as to produce a melted resin; kneading the melted resin; cooling the melted resin kneaded in the kneading, so as to produce a solid resin; and pulverizing the solid resin so as to obtain a pulverized toner, to thereby produce a toner, wherein the melted resin is kneaded in the kneading by using the continuous kneading apparatus according to any one of <1> to <8>.

In a continuous kneading apparatus of the present invention, since a cooling medium passage is provided for a screw member which comes into contact with matter to be kneaded, on the upstream side of an area where the passing matter is continuously kneaded by shear force, it is possible to sufficiently lower the temperature of the matter before it is kneaded and thus to efficiently cool the matter and apply adequate shear force to the matter, which is an excellent effect.

In a method of the present invention for producing a toner, since adequate shear force can be applied to matter to be kneaded, which includes resin(s) and filler(s), by using a continuous kneading apparatus of the present invention in a kneading step in a process of producing a toner, it is possible to obtain a toner in which the filler(s) is/are dispersed sufficiently finely in the resin(s) serving as a base, which is an excellent effect.

DETAILED DESCRIPTION OF THE INVENTION

Continuous Kneading Apparatus

A continuous kneading apparatus of the present invention includes a rotary disc member; a screw member; a drive shaft member to which the rotary disc member and the screw member are fixed; a stationary portion having an internal space in which matter to be kneaded is conveyed; and a cooling medium passage which is provided for the screw member, and through which a cooling medium that is lower in temperature than the matter passing in the internal space passes. If necessary, the continuous kneading apparatus may further include other members.

The following explains an example of a continuous kneading apparatus 100 to which the present invention has been applied.

Figure 1:
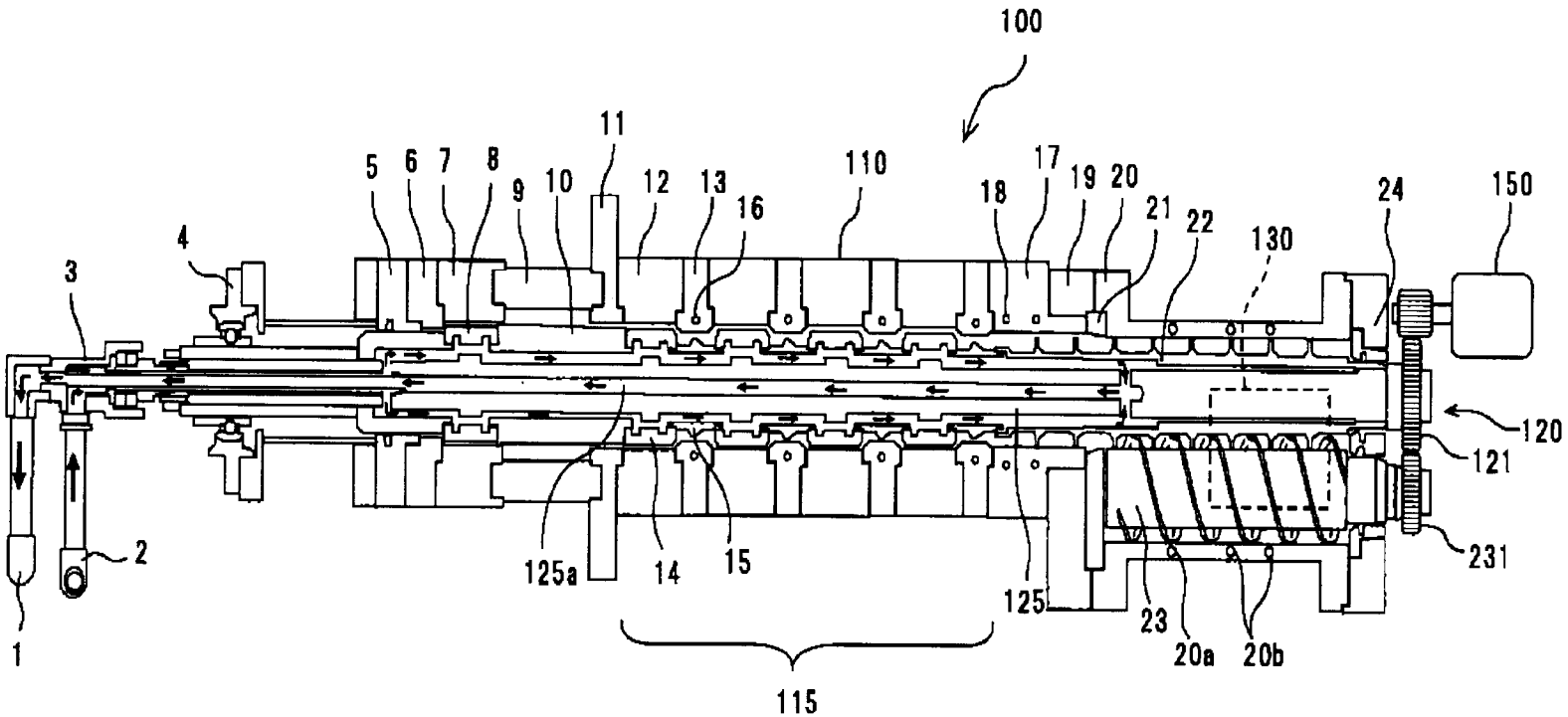
FIG. 1 is a schematic structural drawing exemplarily showing a continuous kneading apparatus of the present embodiment.

FIG. 1 is a schematic structural drawing of an example of the continuous kneading apparatus 100 according to the present embodiment, as seen from above.

The continuous kneading apparatus 100 includes a cylindrical stationary portion 110 having an internal space through which heated and melted matter to be kneaded can pass, and a rotary portion 120 which is placed in the internal space of the stationary portion 110 and rotates thereby continuously kneading the matter in the internal space and, while doing so, conveying the matter in the rotational axis direction (toward the left-hand side in FIG. 1). Further, the continuous kneading apparatus includes as a drive source a drive motor 150 which transmits drive to the rotary portion 120 via a drive transmission gear 121. Also, the continuous kneading apparatus includes a main screw 22 which is placed parallel to the rotary portion 120, and to which the drive is transmitted from the drive motor 150 via the drive transmission gear 121 and a sub drive transmission gear 231; further, the continuous kneading apparatus preferably includes a sub screw 23 as well.

Figure 2:
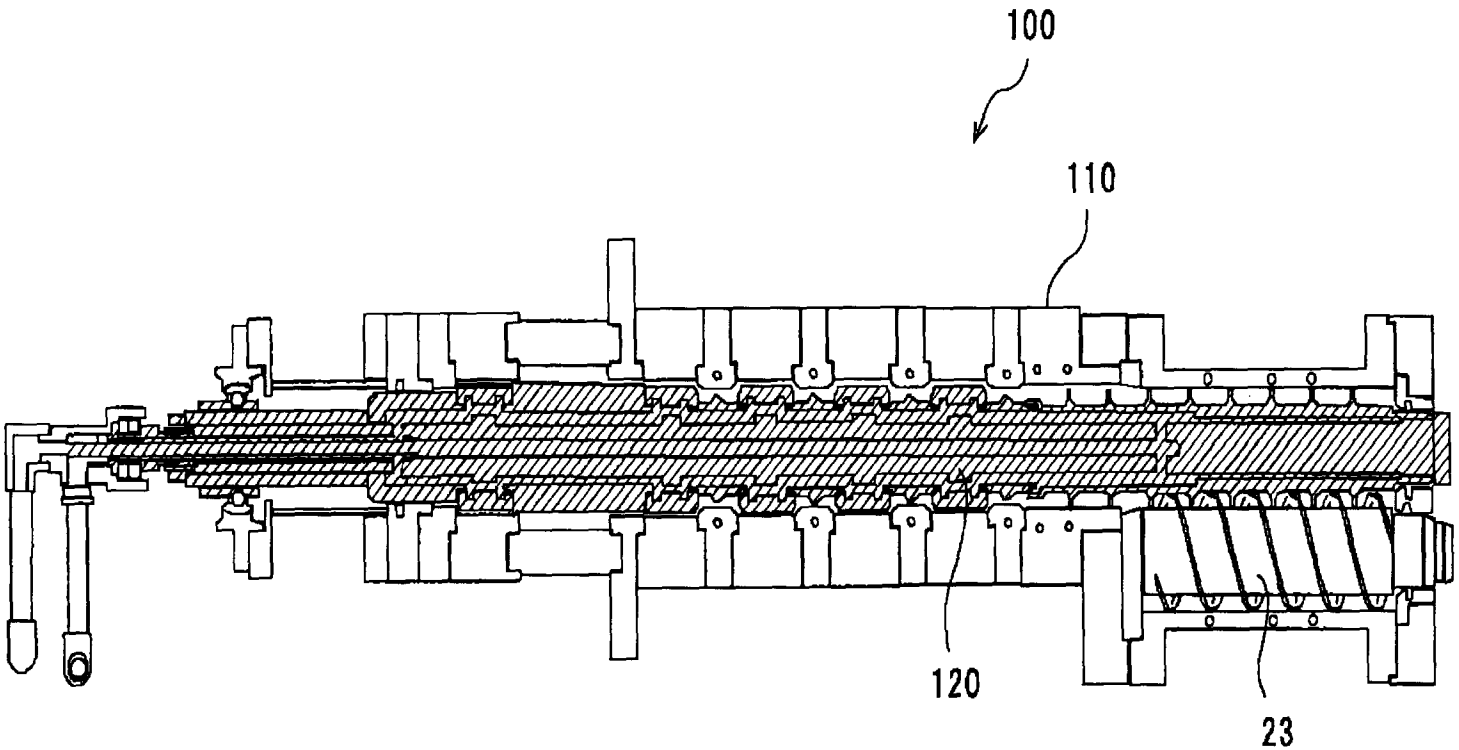
FIG. 2 is an explanatory drawing exemplarily showing a rotary portion.

FIG. 2 is an explanatory drawing showing an example of the rotary portion 120. Members included in the part marked with the oblique lines in FIG. 2 rotate integrally as the rotary portion 120.

A cylindrical feed liner 17 provided with a feed liner cooling medium passage 18 through which a cooling medium such as water passes is provided on the upstream side (right-hand side in FIG. 1) of a kneading portion 115 of the continuous kneading apparatus 100 with respect to the conveyance direction of the matter to be kneaded. Also, a first feed cylinder 19, a cylinder receiver 21, a second feed cylinder 20, etc. are provided upstream of the feed liner 17 with respect to the conveyance direction. Further, a seal box 24 is provided at an end of the second feed cylinder 20 on the upstream side with respect to the conveyance direction.

In the second feed cylinder 20, a downstream-side cooling medium passage 20*a* and an upstream-side cooling medium passage 20*b* are formed as cooling medium passages. A band heater (not shown) is provided on the outer circumference of the area of the second feed cylinder 20, where the downstream-side cooling medium passage 20*a* is formed. Based upon the result of detection performed by a downstream-side temperature sensor (not shown), the band heater and the flow of the cooling medium are controlled and the temperature on the downstream side of the second feed cylinder 20 is controlled. Meanwhile, there is no band heater provided for the area of the second feed cylinder 20, where the upstream-side cooling medium passage 20*b* is formed; when the temperature is higher than a predetermined temperature according to the result of detection performed by an upstream-side temperature sensor (not shown), the flow of the cooling medium is controlled so as to cool the upstream side of the second feed cylinder 20.

An outlet flange 11, a roll 10, an outlet cylinder 7, a stationary flange 6, a bearing flange 5, a pillow block 4, a rotary joint 3, etc. are placed on the downstream side (left-hand side in FIG. 1) of the kneading portion 115 of the continuous kneading apparatus 100 with respect to the conveyance direction of the matter to be kneaded. To the rotary joint 3, a cooling medium outlet pipe 1 and a cooling medium inlet pipe 2 are connected, and the rotary joint 3 is preferably connected to a cooling medium temperature adjusting unit (not shown) via these pipes. Also, a rod 9 serving as a reinforcing member is provided between the roll 10 and the outlet cylinder 7. Further, the rotary portion 120 is provided with an opposite screw 8 in a position on the inside of the stationary flange 6.

In the continuous kneading apparatus 100, the matter to be kneaded, which includes a mixture of one or more resins and one or more functional fillers, is inserted from a supply port 130 provided in the second feed cylinder 20. The inserted matter falls to the engagement portions of the main screw 22 and the sub screw 23 which are rotating. Thereafter, the matter passes through an internal space of the cylindrical feed liner 17 cooled by the cooling medium passing through the feed liner cooling medium passage 18, and the matter is conveyed to the kneading portion 115 on the downstream side.

Next, the kneading portion 115 will be explained.

Figure 3:
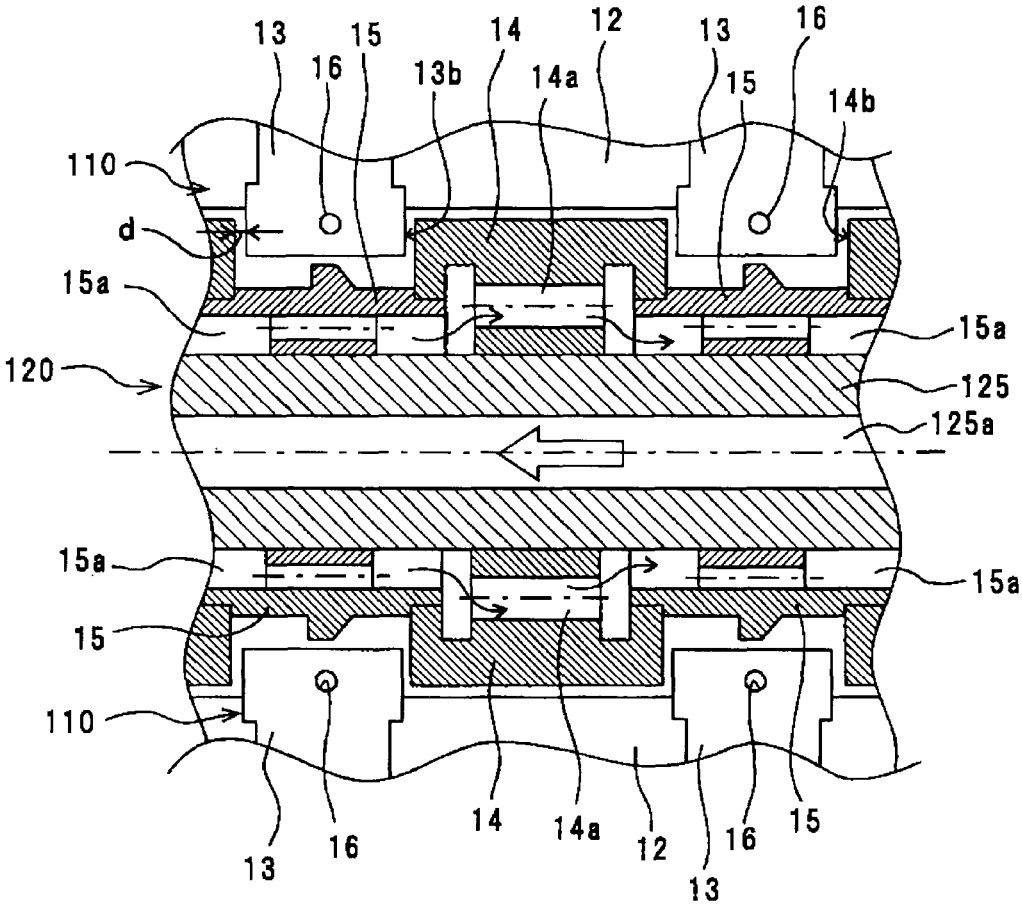
FIG. 3 is an enlarged explanatory drawing exemplarily showing part of a kneading portion.

FIG. 3 is an enlarged explanatory drawing of part of the kneading portion 115.

As shown in FIGS. 1 and 3, regarding the stationary portion 110 at the kneading portion 115, it is preferred that a kneading cylinder 12 and a stationary disc 13 be alternately placed in four places each with respect to the axis direction.

Also, regarding the rotary portion 120 at the kneading portion 115, it is preferred that a rotary disc member 14 be placed in a plurality of places in relation to a drive shaft member 125 with respect to the rotational axis direction of the drive shaft member 125, and that a screw member 15 provided with a screw cooling medium passage 15*a* be placed upstream of each of the rotary disc members 14; it is more preferred that the rotary disc members 14 and the screw members 15 be fixed alternately with respect to the axis direction and rotate on the same rotational axis as that of the main screw 22. Parenthetically, the rotary disc members 14 and the screw members 15 engage with each other, and a sealing member (not shown) is sandwiched between each engagement portion.

The arrows in FIGS. 1 and 3 each indicate a flow of a cooling medium, such as water, in the rotary portion 120. As shown in FIGS. 1 and 3, it is preferred that the screw cooling medium passage 15*a* provided for each screw member 15 and a rotary disc cooling medium passage 14*a* provided for each rotary disc member 14 be adjacent to each other and communicate with each other, constituting a flow path.

Figure 4:
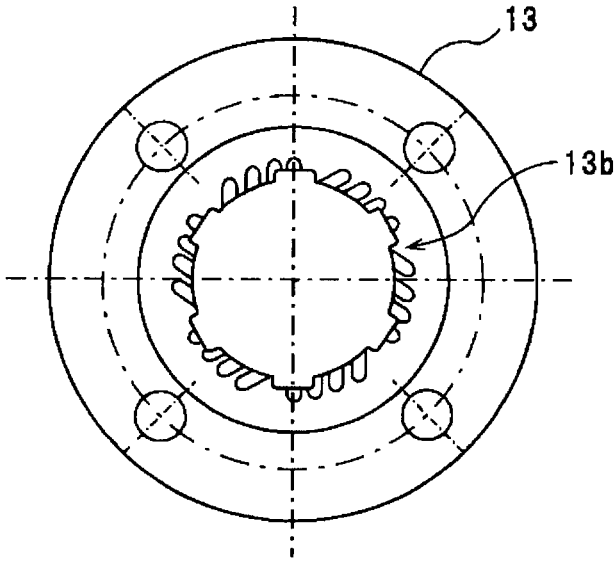
FIG. 4 is an example of an external view of a stationary disc, as seen from a direction parallel to the rotational axis.

FIG. 4 is an external view of the stationary disc 13, as seen from a direction parallel to the rotational axis.

As shown in FIG. 4, regarding the inner circumferential surface of the stationary disc 13, a stationary disc opposed surface 13*b* (which is the surface of an internal wall of the stationary portion, facing part of the rotary disc member 14) preferably has a concavo-convex shape. Also, a stationary disc cooling medium passage 16, through which a cooling medium such as water can pass, is preferably provided in the stationary disc 13, and a band heater (not shown) is preferably provided on the outer circumference of the stationary disc 13. Further, the stationary disc 13 is provided with a temperature sensor (not shown); based upon the result of detection performed by this temperature sensor, the band heater and the flow of the cooling medium are controlled, and the temperature of the stationary disc 13 is thus controlled. Specifically, when the temperature of the stationary disc 13, detected by the temperature sensor, is lower than a desired temperature, heating is performed by the band heater. When the temperature of the stationary disc 13 is higher than the desired temperature, a cooling medium circulating mechanism (not shown) is driven so as to allow the cooling medium in the stationary disc cooling medium passage 16 to flow, and the cooling medium in the stationary disc 13 is replaced with a cooling medium whose temperature has been appropriately adjusted, thereby cooling the stationary disc 13. As just described, by controlling the temperature of each stationary disc 13, the matter to be kneaded, which has been conveyed from the feed liner 17 to the kneading portion 115, can be subjected to temperature control in the vicinities of the four stationary discs 13.

Figure 5:
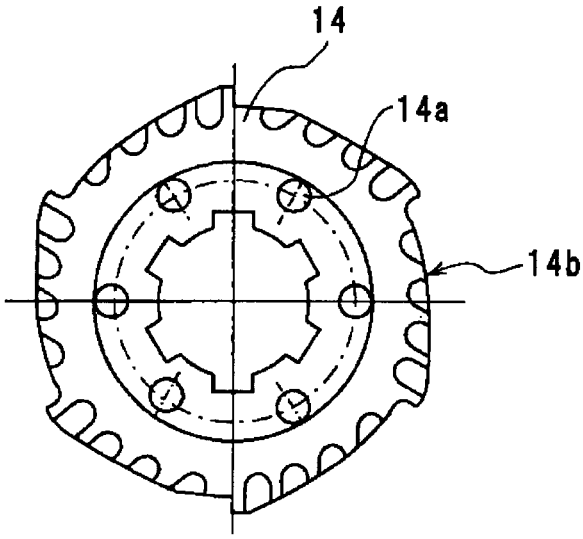
FIG. 5 is an example of an external view of a rotary disc member, as seen from a direction parallel to the rotational axis.

FIG. 5 is an external view of the rotary disc member 14, as seen from a direction parallel to the rotational axis.

As shown in FIG. 5, regarding the outer circumferential surface of the rotary disc member 14, a rotary disc opposed surface 14*b* which faces the stationary disc opposed surface 13*b* of the stationary disc 13 preferably has a concavo-convex shape. Also, a rotary disc cooling medium passage 14*a*, through which a cooling medium such as water can pass, is preferably provided in the rotary disc member 14.

When the heated and melted matter to be kneaded passes between the stationary disc opposed surface 13*b* and the rotary disc opposed surface 14*b* both having the concavo-convex shapes, the matter receives shear stress, and thus the filler(s) in the resin(s) serving as a base is/are kneaded and dispersed.

As shown in FIG. 1, the rotary disc members 14, the screw members 15, the roll 10 and the opposite screw 8, which constitute the rotary portion 120, are cooled by the same cooling medium. In the continuous kneading apparatus 100 of the present embodiment, the cooling medium, whose temperature has been adjusted to a desired temperature by a cooling medium temperature adjusting unit (not shown)

placed outside the stationary portion 110, flows from the cooling medium inlet pipe 2 into the rotary portion 120 via the rotary joint 3. In the rotary portion 120, the cooling medium flows through the opposite screw 8, the roll 10, the rotary disc members 14, the screw members 15 and the cooling medium passages provided for the respective members, thereby cooling the members. Thereafter, the cooling medium flows through the rotary disc members 14 and the screw members 15 (which are placed in four places each) in an alternate manner, then flows from a point at the main screw 22 into a drive shaft cooling medium passage 125*a* provided for the drive shaft member 125, and thus the cooling medium advances in the opposite direction. Thereafter, the cooling medium flows inside the drive shaft cooling medium passage 125*a* toward the left-hand side in FIG. 1, and the cooling medium is then conveyed from the cooling medium outlet pipe 1 back to the cooling medium temperature adjusting unit via the rotary joint 3.

Next, a discharge portion for a kneaded resulting product, provided in the continuous kneading apparatus 100 of the present embodiment, will be explained. Kneading and dispersion in a kneading area and application of conveyance force which advances toward the downstream side (left-hand side in FIG. 1) with respect to the conveyance direction by means of the screw members 15 are repeated in a manner that conforms to the structure, then the matter to be kneaded arrives, as a kneaded resulting product, at the outlet flange 11. Thereafter, the materials are discharged; here, the discharge mechanisms shown in FIGS. 6 to 8 may be selectively used according to the properties of the materials, especially the resin(s), and the intended purpose.

Figure 6A:
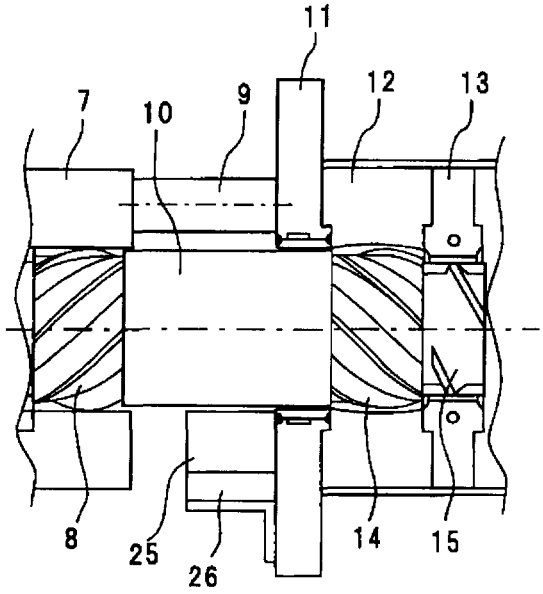
FIG. 6A is a top view exemplarily showing a scraper-type discharge mechanism.
Figure 6B:
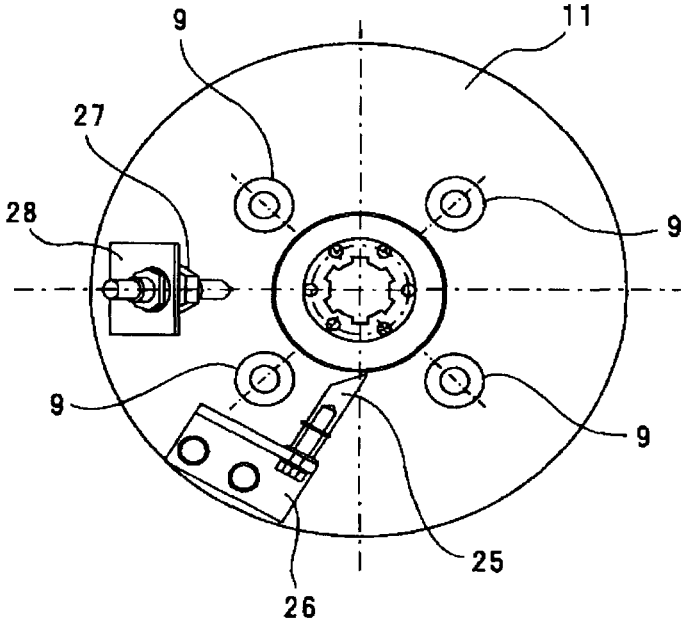
FIG. 6B is a front view exemplarily showing the scraper-type discharge mechanism.

FIGS. 6A and 6B are explanatory drawings of a scraper-type discharge mechanism. FIG. 6A is a top view of the discharge mechanism, as seen from the same direction as that in FIG. 1. FIG. 6B is a front view of the discharge mechanism, as seen from a direction parallel to the rotational axis.

The discharge mechanism shown in FIGS. 6A and 6B includes a scraper 25 whose end touches a roll 10, a scraper supporting stand 26, a cooling air nozzle 28 for applying cooling air to a kneaded resulting product wound around the roll 10, a cooling air nozzle supporting stand 27 and so forth. In the scraper-type discharge mechanism shown in FIGS. 6A and 6B, the kneaded resulting product wound around the roll 10 in an annular form, which is to be discharged from an outlet flange 11, is stripped off by the scraper 25 and thus collected. Also, by applying cooling air to the discharged materials, which correspond to the kneaded resulting product to be discharged from the outlet flange 11, by means of the cooling air nozzle 28, it is possible to promote solidification of the materials and improve the discharging property of the materials.

Figure 7A:
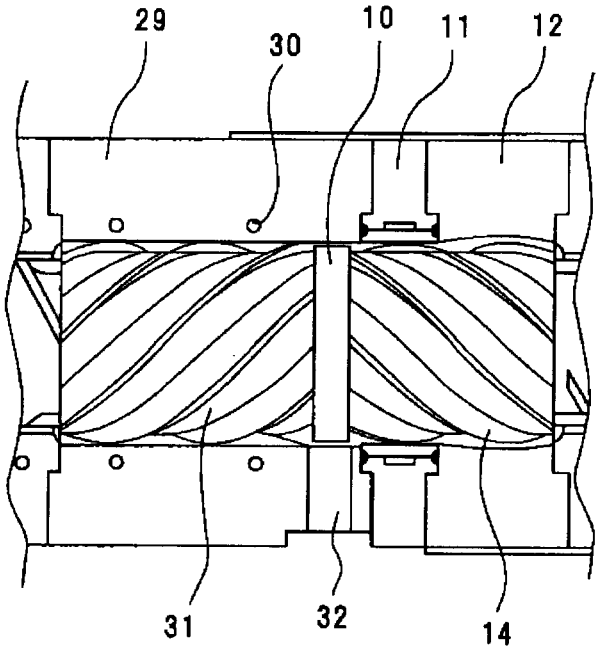
FIG. 7A is a top view exemplarily showing a discharge mechanism of a die discharge type.
Figure 7B:
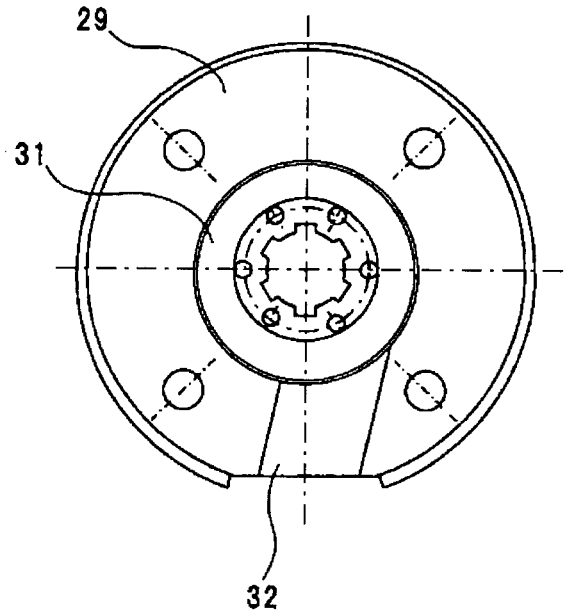
FIG. 7B is a front view exemplarily showing the discharge mechanism of the die discharge type.

FIGS. 7A and 7B are explanatory drawings of a discharge mechanism of a die discharge type. FIG. 7A is a top view of the discharge mechanism, as seen from the same direction as that in FIG. 1. FIG. 7B is a front view of the discharge mechanism, as seen from a direction parallel to the rotational axis.

The discharge mechanism shown in FIGS. 7A and 7B includes a discharge die 29, a roll-attached screw 31, a die hole 32 and so forth. The discharge die 29 is provided with a discharge die cooling medium passage 30, through which a cooling medium such as water passes. The discharge mechanism shown in FIGS. 7A and 7B involves discharging a kneaded resulting product from the die hole 32 provided in such a manner as to face downward, which makes it possible to discharge the product stably even when the amount of materials processed is large.

Figure 8A:
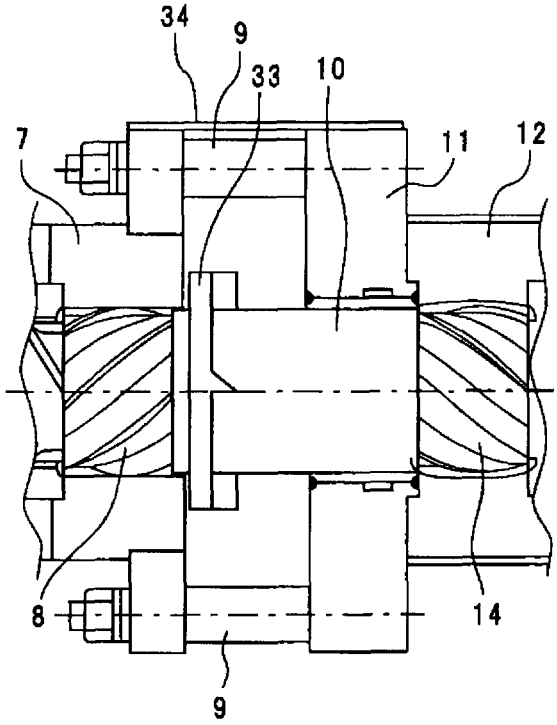
FIG. 8A is a top view exemplarily showing a discharge mechanism of a crusher blade discharge type.
Figure 8B:
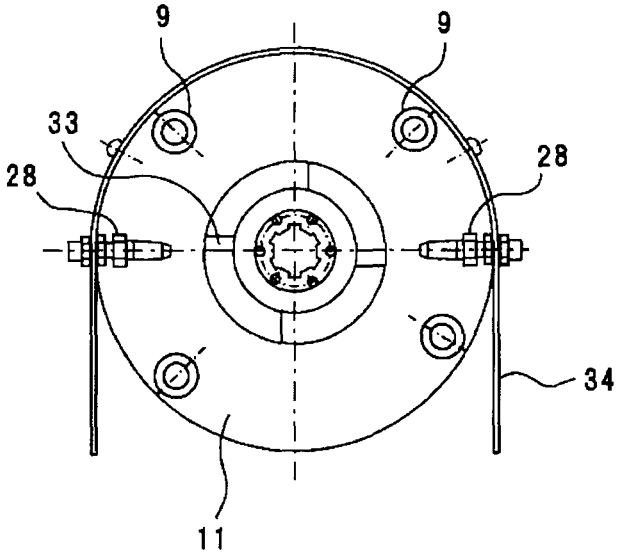
FIG. 8B is a front view exemplarily showing the discharge mechanism of the crusher blade discharge type.

FIGS. 8A and 8B are explanatory drawings of a discharge mechanism of a crusher blade discharge type. FIG. 8A is a top view of the discharge mechanism, as seen from the same direction as that in FIG. 1. FIG. 8B is a front view of the discharge mechanism, as seen from a direction parallel to the rotational axis.

The discharge mechanism shown in FIGS. 8A and 8B includes cooling air nozzles 28, a cooling air nozzle supporting cover 34, crusher blades 33 and so forth. The discharge mechanism shown in FIGS. 8A and 8B involves applying cooling air to a kneaded resulting product, discharged from an outlet flange 11, by means of the cooling air nozzles 28, and solidifying the kneaded resulting product such that it is not wound around a roll 10. When thusly solidified, the kneaded resulting product is solidified into a cylindrical form and pushed toward its advancing direction without rotating. The pushed cylindrical kneaded resulting product reaches the rotating crusher blades 33 provided adjacently to the roll 10, and it is crushed and can be collected as solid matter. Since this mechanism allows the kneaded resulting product to be collected as solid matter, it has the merit of not necessitating a crushing step after kneading.

Next, characteristic parts of the continuous kneading apparatus 100 will be explained.

As shown in FIG. 3, the continuous kneading apparatus 100 includes the screw cooling medium passage 15*a* which is provided for the screw member 15 placed upstream of the rotary disc member 14 with respect to the conveyance direction of matter to be kneaded, and through which a cooling medium that is lower in temperature than the matter passes.

Generally, regarding the matter to be kneaded, when shear stress is applied into the melted resin(s) to disperse the functional filler(s) therein, there are three important factors.

A first important factor is the distance between wall surfaces, between which the matter to be kneaded is sandwiched, in a kneading area. With regard to the continuous kneading apparatus 100, the above distance is equivalent to the distance between the rotary disc opposed surface 14*b* of the rotary disc member 14 and the stationary disc opposed surface 13*b* of the stationary disc 13; the smaller this distance is, the greater the shear stress received by the matter is.

A second important factor is the relative velocity difference between the two wall surfaces, between which the matter to be kneaded is sandwiched. With regard to the continuous kneading apparatus 100, since the stationary disc 13 does not move, the number of revolutions of the rotary disc member 14 is equivalent to this factor. As the number of revolutions of the rotary disc member 14 is increased, the shear stress received by the matter becomes greater.

A third important factor is the viscosity of the matter to be kneaded, and this factor is deemed most dominant with respect to shear stress. When the viscosity of the matter is low, there is loss of mechanical energy; therefore, the higher the viscosity of the matter is, the greater the shear stress is.

In the continuous kneading apparatus 100, the temperature of the stationary disc 13, which is a constituent of the kneading area, is controlled, and the rotary disc member 14 is cooled by a cooling medium whose temperature has been appropriately adjusted. Therefore, the matter to be kneaded which lies in the kneading area can have an intended temperature distribution, for example a low-temperature-based temperature distribution with less variation between the inner and outer sides, and thus it is possible to provide high shear stress to the matter. Moreover, since the screw members 15 positioned at the front and back of the kneading area are also cooled by a cooling medium whose temperature has been appropriately adjusted, it is possible to efficiently cool the matter before it enters the kneading area and thus to easily provide high shear stress to the matter in the kneading area.

In each of the kneading apparatuses described in JP-A No. 52-148868 and JP-B No. 54-024743, a cooling medium passage, through which a cooling medium passes, is provided for a rotary disc member in a rotary portion, but there is no cooling medium passage provided for a screw member.

Figure 10:
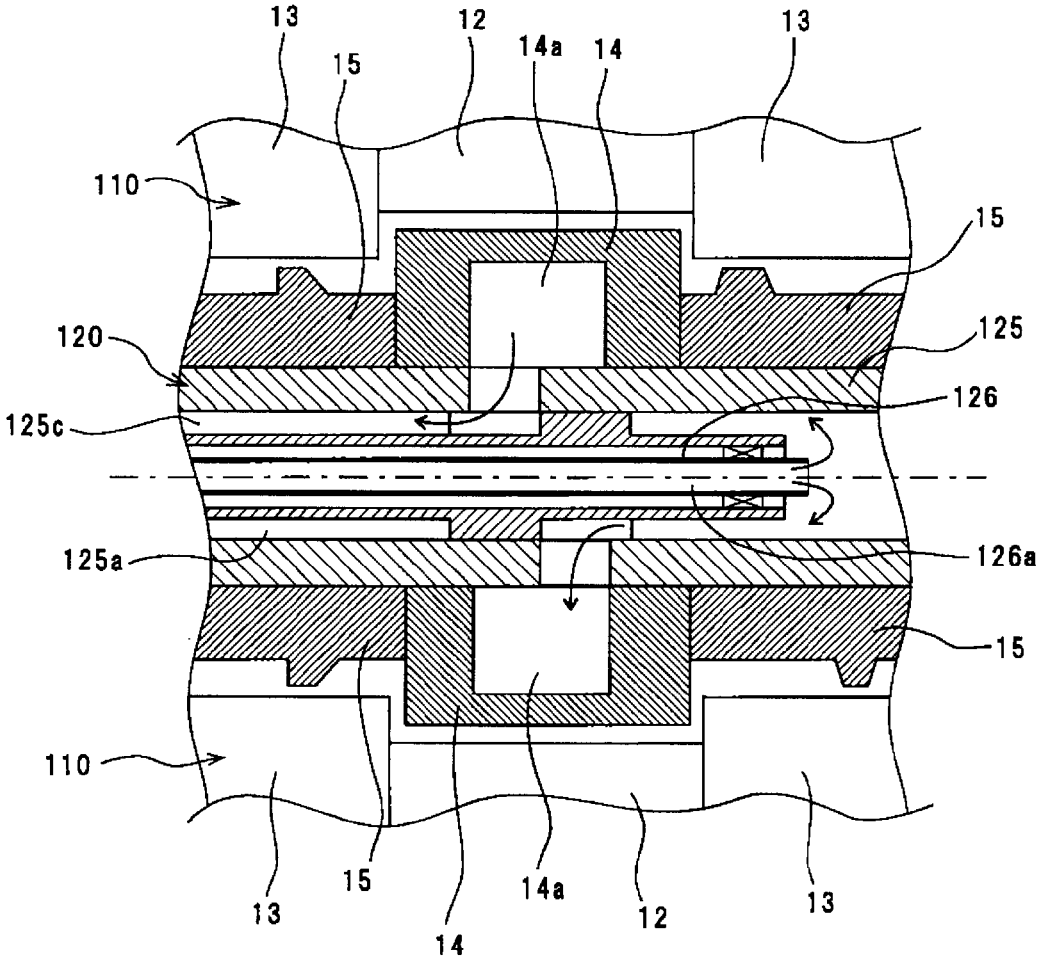
FIG. 10 is an enlarged explanatory drawing showing part of a kneading portion which is not provided with a cooling medium passage for directly cooling a screw member.

FIG. 10 is an enlarged explanatory drawing showing part of a kneading portion of a continuous kneading apparatus, without a cooling medium passage being provided for a screw member, as in the case of the kneading apparatuses described in JP-A No. 52-148868 and JP-B No. 54-024743.

In the structure shown in FIG. 10, a stationary shaft member 126 is placed inside a drive shaft member 125, a stationary shaft cooling medium passage 126*a* is formed inside the stationary shaft member 126, and a drive shaft cooling medium passage 125*a* is formed between an internal wall surface of the drive shaft member 125 and an external wall surface of the stationary shaft member 126. Also, there is a hole provided in the drive shaft member 125 at the place where a rotary disc member 14 is fixed, so that a rotary disc cooling medium passage 14*a* provided for the rotary disc member 14 and the drive shaft cooling medium passage 125*a* communicate with each other. A cooling medium cannot continuously pass through the drive shaft cooling medium passage 125*a* at the place where the hole is provided. In the foregoing structure, a cooling medium flowing through the drive shaft cooling medium passage 125*a* from the upstream side (right-hand side in FIG. 10) enters the rotary disc cooling medium passage 14*a* via the hole. Thereafter, the cooling medium moves in a rotational direction inside the rotary disc cooling medium passage 14*a* along the outer circumferential surface of the drive shaft member 125, then enters the drive shaft cooling medium passage 125*a* via a hole different from the hole through which it entered the rotary disc cooling medium passage 14*a*, and subsequently moves in the drive shaft cooling medium passage 125*a* toward the downstream side (left-hand side in FIG. 10).

In the continuous kneading apparatus shown in FIG. 10, similarly to the continuous kneading apparatus 100 of the present embodiment, the rotary disc member 14 and a screw member 15 are both produced as members different from the drive shaft member 125, and integrally rotate as a rotary portion, fixed to the drive shaft member 125. However, the continuous kneading apparatus shown in FIG. 10 differs from the continuous kneading apparatus 100 of the present embodiment in that a cooling medium passage, through which a cooling medium is passed, is not provided for the screw member 15.

In the foregoing structure, there is no cooling medium passage for directly cooling the screw member 15 that conveys a matter to be kneaded toward a kneading area where the matter is subjected to compression shearing between a stationary disc 13 and the rotary disc member 14 or that conveys the matter, which has passed the kneading area, further downstream; thus, even when the temperature distribution of the matter is made nearly uniform in the kneading area, the temperature of the matter in the area where it is conveyed by the screw member 15 varies depending upon the situation, and so the efficiency with which the matter is cooled degrades.

Meanwhile, in the continuous kneading apparatus 100 of the present embodiment, since the screw members 15 positioned at the front and back of the kneading area are also cooled by a cooling medium whose temperature has been appropriately adjusted, the matter to be kneaded can be efficiently cooled before it is supplied into the kneading area. Therefore, high shear stress can be easily provided to the matter in the kneading area, and thus the filler(s) can be finely dispersed in the resin(s) serving as a base.

Regarding each of the kneading apparatuses described in JP-A No. 52-148868 and JP-B No. 54-024743, a conveyance screw provided at a raw material supply portion situated below a supply port, through which matter to be kneaded is inserted into the apparatus, has a monoaxial structure, and so the apparatus has a poor conveyance property. Thus, there could be a backflow of the matter at the raw material supply portion, when low-bulk-density materials are used. Also, apart from the bulk density of the materials, when resin(s) is/are kneaded at high viscosity, the resin discharging property degrades, the matter remains in the apparatus and there is an increase in internal pressure, so that there could be a backflow of raw materials at the raw material supply portion.

Meanwhile, in the continuous kneading apparatus 100 of the present embodiment, two screws, i.e., the main screw 22 and the sub screw 23, are placed inside the second feed cylinder 20 constituting a raw material supply portion. When the temperature of the internal space of the stationary portion 110 is lowered so as to disperse the filler(s) finely, the balance between supply and discharge becomes unstable and there could be a backflow of the inserted materials at the raw material supply portion, owing to degradation of the discharging property as described above. If there is only one screw, i.e., the main screw 22, inside the raw material supply portion, the material conveying property is poor; accordingly, the provision of the sub screw 23 in addition to the main screw 22 makes it possible to dramatically improve the material conveying property at the raw material supply portion and suppress the occurrence of a backflow of the raw materials.

Regarding each of the kneading apparatuses described in JP-A No. 52-148868 and JP-B No. 54-024743, since a stationary portion that is a constituent of a kneading portion is integrally formed, production and assembly thereof are difficult and the cost of the apparatus increases. Also, once the stationary portion has been installed, it is not easy to change the structure (type, number and shape of discs, etc.) of the apparatus, so that a change of the structure necessitates producing the stationary portion all over again in some cases.

Meanwhile, in the continuous kneading apparatus 100 of the present embodiment, the stationary portion 110 that is a constituent of the kneading portion 115 has a structure in which the kneading cylinders 12 and the stationary discs 13 are alternately disposed and fixed with respect to the axis direction. By alternately fixing the kneading cylinders 12 and the stationary discs 13, which are members different from each other, it is possible to easily produce the stationary portion 110 that is a constituent of the kneading portion 115 and thus to suppress an increase in the cost of the apparatus. Further, by increasing the numbers of the kneading cylinders 12 and the stationary discs 13 alternately disposed or by replacing the stationary discs 13 with those in a different shape, it is possible to change the structure of the apparatus with ease. By increasing the numbers of the stationary discs 13 and the rotary disc members 14, the number of kneading areas increases and the filler(s) can be dispersed even more finely.

Each of the kneading apparatuses described in JP-A No. 52-148868 and JP-B No. 54-024743 includes shaft members having a concentric biaxial structure formed with a stationary shaft and a drive shaft. Regarding the flow path of a cooling medium in this structure, first the cooling medium is moved through a cooling medium passage situated inside the stationary shaft, from the downstream side (side where matter to be kneaded is discharged) of the kneading apparatus toward the upstream side (side where the matter is inserted into the apparatus). Thereafter, the cooling medium is moved from an end of the cooling medium passage situated inside the stationary shaft to a cooling medium passage situated inside the drive shaft, the advancing direction of the cooling medium is thereby reversed, and the cooling medium flows from the upstream side to the downstream side of an outer-side cooling medium passage provided on the outer side in the drive shaft by means of a rotary disc member and then discharges from the apparatus.

In a kneading apparatus having the foregoing structure, the temperature of a cooling medium controlled by a cooling medium temperature adjusting unit before supplied to the apparatus is difficult to maintain until the cooling medium reaches a kneading dispersion portion (situated between a stationary disc and a rotary disc), thereby degrading the efficiency with which matter to be kneaded is cooled.

Meanwhile, in the continuous kneading apparatus 100 of the present embodiment, the cooling medium, whose temperature has been appropriately adjusted by the cooling medium temperature adjusting unit (not shown), passes through the cooling medium passages inside the rotary disc member 14 and the screw member 15 fixed to the drive shaft member 125, then passes through the drive shaft cooling medium passage 125*a* inside the drive shaft member 125 and subsequently returns to the cooling medium temperature adjusting unit. To efficiently cool the matter to be kneaded which is present at the kneading portion 115, minimizing thermal loss of the cooling medium, such as water, whose temperature has been adjusted to a desired temperature, it is preferable to pass the cooling medium firstly from the side of the screw member 15 and the rotary disc member 14 that are in dominant positions concerning kneading dispersion, i.e., positions closer to the matter than the drive shaft member 125 is. In the kneading portion 115 of the continuous kneading apparatus 100, first the cooling medium passes through the cooling medium passages for the rotary disc member 14 and the screw member 15, then passes through the cooling medium passage for the drive shaft member 125 and subsequently returns to the cooling medium temperature adjusting unit. Thus, the matter in the kneading portion 115 can be efficiently cooled, and the fine dispersibility of the filler(s) by means of kneading can be dramatically improved.

Also, in the continuous kneading apparatus 100 of the present embodiment, the minimum clearance d between the stationary disc 13 and the rotary disc member 14 is preferably set in the range of 0.2 mm to 5 mm. When the minimum clearance d is greater than 5 mm, the distance between the wall surfaces is large, so that the energy of the moving surface (rotary disc opposed surface 14*b* of the rotary disc member 14) is not easily transmitted to the entire matter to be kneaded, and consequently the shear stress received by the matter may decrease. When the minimum clearance d is less than 0.2 mm, the stationary disc 13 and the rotary disc member 14 may thermally expand, possibly causing a backflow at the raw material supply portion, and the stationary disc 13 and the rotary disc member 14 may touch each other, possibly causing abrasion of the surfaces of the discs and an overload on the drive. It is more preferred that the minimum clearance d satisfy the relationship 0.2 mm<d<5 mm, particularly preferably 0.4 mm<d<3 mm. By adjusting the minimum clearance d to this preferred range, it is possible to dramatically increase the shear stress applied to the matter while performing stable operation without causing an overload on the apparatus.

Thus, a continuous kneading apparatus for resin compounding, in which materials can be highly dispersed in matter to be kneaded, by means of strong shear force, and stable operation is possible, can be realized by the continuous kneading apparatus 100 of the present embodiment.

Specific examples of applied products of the resin compounding include an electrostatic image developing toner obtained by dispersing a pigment, a wax, a charge controlling agent, etc. in a resin; a pigment masterbatch obtained by dispersing a pigment in a resin; a flame-retardant plastic obtained by dispersing a flame retardant in a resin; and a foaming agent masterbatch obtained by dispersing a foaming agent in a resin.

Conventionally known applied products of the resin compounding include electrostatic image developing toners for use in electrophotographic image forming apparatuses.

Methods for developing electrostatic images are broadly classified into liquid developing methods that use developers obtained by finely dispersing pigments, dyes, etc. in insulating organic liquids; and dry developing methods such as cascade method, magnetic brush method and powder cloud method, that use fine powder developers called toners, obtained by dispersing pigments in natural or synthetic resins. Here, a toner for use in a dry developing method will be explained.

A toner for use in image formation in accordance with a dry developing method is generally obtained by mixing a binder resin, a wax, a colorant, a charge controlling agent, etc. in predetermined amounts and kneading the mixture with the use of a kneading apparatus so as to produce kneaded matter, then pulverizing and classifying the kneaded matter. To maintain performances and qualities required for the toner, fine dispersion of additional materials in the binder resin, in particular, is required in the kneading step for the toner. There is a tendency for the amount of wax contained in the toner to increase, especially so as to adapt to the low-temperature fixation intended to meet the present-day energy saving; when the wax dispersion diameter in the toner is large, smearing in a developing device may arise, and therefore it is preferable to disperse the wax finely; however, the wax is lower in softening temperature than the resin and is not highly compatible with the resin. Accordingly, it is demanded that the shear stress at the time of kneading be increased to disperse the wax finely.

In response to such a demand, use of the continuous kneading apparatus 100 of the present embodiment for the kneading step at the time of toner production makes it possible to disperse the wax finely in the binder resin. Thus, it is possible to obtain an electrostatic image developing toner with improved durability against an image forming apparatus.

MODIFIED EXAMPLE

Figure 9:
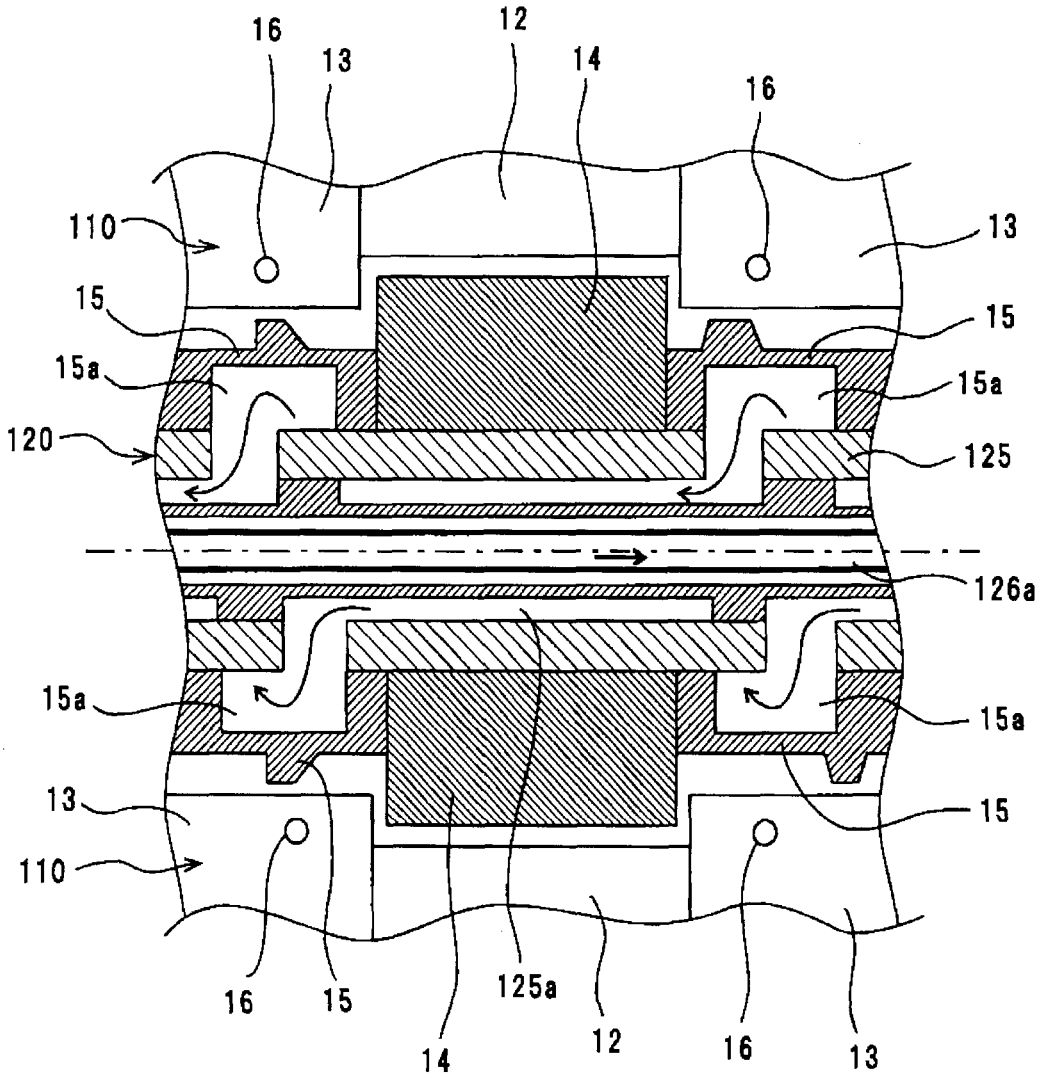
FIG. 9 is an enlarged explanatory drawing exemplarily showing part of a kneading portion according to a modified example.

It should be noted that the structure in which a cooling medium passage is provided for the screw member 15 that is a constituent of the rotary portion 120 is not limited to the structure shown in FIG. 3. FIG. 9 is an enlarged explanatory drawing showing part of a kneading portion 115 of a continuous kneading apparatus 100 according to a modified example, in which a screw cooling medium passage 15*a* is provided for a screw member 15 but there is no cooling medium passage provided for a rotary disc member 14. In the structure according to the modified example shown in FIG. 9, shaft members have a concentric biaxial structure formed with a drive shaft member 125 and a stationary shaft member 126, as in the case of the structure explained referring to FIG. 10. In the continuous kneading apparatus 100 according to the modified example, a cooling medium in a drive shaft cooling medium passage 125*a* provided for the drive shaft member 125 flows into the screw cooling medium passage 15*a* for the screw member 15 via a hole. After flowing through the screw cooling medium passage 15*a* in a rotational direction, the cooling medium enters the drive shaft cooling medium passage 125*a* through a hole different from the hole through which it entered the screw cooling medium passage 15*a*. This structure makes it possible to efficiently cool matter to be kneaded which comes into contact with the screw member 15. Although the continuous kneading apparatus 100 according to the modified example is inferior to the continuous kneading apparatus 100 according to the embodiment described above in terms of the function of suppressing an increase in the temperature of the matter in a kneading area because there is no cooling medium passage provided for the rotary disc member 14, the matter can be efficiently cooled before it is supplied into the kneading area. Thus, the matter which is in a low-temperature and highly viscous state can be supplied into the kneading area, which makes it possible to provide high shear force to the matter and achieve finer dispersion of filler(s) in resin(s) serving as a base than in the structure without a cooling medium passage being provided for the screw member 15.

Method for Producing Toner

A method of the present invention for producing a toner includes a weighing step, a heating step, a kneading step, a cooling step and a pulverizing step, and preferably includes a classifying step and an adding step. If necessary, the method may further include other steps.

The weighing step is a step of weighing toner raw materials which include at least a resin, so as to prepare matter to be kneaded.

The heating step is a step of heating and melting the matter to be kneaded, which has been prepared by the weighing, so as to produce a melted resin.

The kneading step is a step of kneading the melted resin, using the above-mentioned continuous kneading apparatus of the present invention, such that functional filler(s) is/are kneaded and dispersed in resin(s) serving as a base.

The cooling step is a step of cooling the heated and melted resin kneaded in the kneading step, so as to produce a solid resin.

The pulverizing step is a step of pulverizing the solid resin so as to obtain a pulverized toner.

The classifying step is a step of classifying the pulverized toner obtained in the pulverizing step, such that the pulverized toner has a desired particle diameter.

The adding step is a step of mixing the pulverized toner with additive(s) such as silica, titanium, etc. after the classifying step.

The method of the present invention for producing a toner makes it possible to obtain a toner in which filler(s) is/are dispersed sufficiently finely in resin(s) serving as a base by kneading a melted resin with the use of the above-mentioned continuous kneading apparatus of the present invention because adequate shear force can be applied to the matter to be kneaded which includes the resin(s) and the filler(s).

EXAMPLES

The following specifically explains the present invention, referring to Examples of the present invention. It should, however, be noted that the scope of the present invention is not confined to these Examples.

Experiment

An experiment to compare functions of toners as kneaded resulting products was carried out, as the continuous kneading apparatus 100 of the embodiment shown in FIG. 1 with altered conditions was used for a kneading step in a process of producing each toner.

Toner materials to be kneaded in the continuous kneading apparatus for this experiment were as follows.

Polyester resin: 100 parts by mass

Cyan pigment: 10 parts by mass

Carnauba wax: 5 parts by mass

Quaternary ammonium salt: 0.5 parts by mass

These raw materials were sufficiently mixed using SUPERMIXER (SMV-200, manufactured by KAWATA MFG Co., Ltd.), and powder raw materials were thus obtained.

The process of producing a toner includes a weighing step, a heating step, a kneading step, a cooling step, a pulverizing step, a classifying step and an adding step. The weighing step is a step of weighing a plurality of raw materials, including resin(s), that constitute a toner so as to prepare matter to be kneaded. The heating step is a step of heating and melting the matter prepared by the weighing, so as to produce a melted resin. The kneading step is a step of kneading the melted resin such that functional filler(s) is/are kneaded and dispersed in the resin(s) serving as a base. The cooling step is a step of cooling the heated and melted resin kneaded in the kneading step, so as to produce a solid resin. The pulverizing step is a step of pulverizing the solid resin so as to obtain a pulverized toner. The pulverized toner obtained in the pulverizing step has a particle size of 5 μm to 10 μm or so; accordingly, toner particles which are too large or too small are removed from the pulverized toner obtained in the pulverizing step, and only a pulverized toner with an intended particle diameter range is thus obtained. After the particle diameter range of the pulverized toner has been adjusted to the predetermined range, the pulverized toner is mixed with additive(s) such as silica, titanium, etc. in the adding step.

Structures and operational conditions of continuous kneading apparatuses of Examples and Comparative Example are shown in Table 1.

As a discharge mechanism, the scraper-type discharge mechanism explained referring to FIG. 6 was used. Also, Examples 2 to 6 and Comparative Example were under the same conditions as those of Example 1 except for the apparatus structures shown in Table 1.

TABLE 1

| | Number of screws | Placement of stationary disc | Placement of rotary disc member | Minimum clearance | Amount of material supplied | Number of revolutions of rotary portion | Temp. of second feed cylinder | Temp. of first stationary disc | Temp. of second stationary disc | Temp. of third and fourth stationary discs | Temp. of cooling medium at rotary portion | Direction of flow of cooling medium at rotary portion |
|---|---|---|---|---|---|---|---|---|---|---|---|---|
| Ex. 1 | one | one pair | one pair | 8 (mm) | 10 (kg/h) | 50 (rpm) | 60 (° C.) | 60 (° C.) | 60 (° C.) | — | 60 (° C.) | from inside to outside |
| Ex. 2 | two | one pair | one pair | 8 (mm) | 10 (kg/h) | 50 (rpm) | 60 (° C.) | 60 (° C.) | 60 (° C.) | — | 60 (° C.) | from inside to outside |
| Ex. 3 | two | one pair | one pair | 1 (mm) | 10 (kg/h) | 50 (rpm) | 60 (° C.) | 60 (° C.) | 60 (° C.) | — | 60 (° C.) | from inside to outside |
| Ex. 4 | two | four places | four places | 1 (mm) | 10 (kg/h) | 50 (rpm) | 60 (° C.) | 60 (° C.) | 60 (° C.) | 60 (° C.) | 60 (° C.) | from inside to outside |
| Ex. 5 | two | four places | four places | 1 (mm) | 10 (kg/h) | 50 (rpm) | 60 (° C.) | 60 (° C.) | 60 (° C.) | 60 (° C.) | 60 (° C.) | from outside to inside |
| Ex. 6 | two | one pair | one pair | 0.1 (mm) | 10 (kg/h) | 50 (rpm) | 60 (° C.) | 60 (° C.) | 60 (° C.) | — | 60 (° C.) | from inside to outside |
| Comp. Ex. | one | one pair | one pair | 8 (mm) | 10 (kg/h) | 50 (rpm) | 60 (° C.) | 60 (° C.) | 60 (° C.) | — | — | — |

Regarding the term "number of screws" in Table 1, the condition of "two" refers to a structure where the number of screws placed in a raw material supply portion is two, as in the case of the main screw 22 and the sub screw 23 of the continuous kneading apparatus 100 shown in FIG. 1. Meanwhile, the condition of "one" regarding "number of screws" refers to a structure where there is only one screw, which corresponds to the main screw 22, placed in the raw material supply portion.

Regarding the terms "placement of stationary disc" and "placement of rotary disc member" in Table 1, the condition of "four places" (Examples 4 and 5) refers to a structure in which the stationary disc 13 and the rotary disc member 14 are placed in four places each with respect to the axis direction, as in the continuous kneading apparatus 100 shown in FIG. 1. The condition of "one pair" (Examples 1 to 3 and 6, and Comparative Example) refers to a structure in which two stationary discs 13 are placed such that one rotary disc member 14 is sandwiched therebetween with respect to the axis direction, as shown by the part of the kneading portion 115 in FIG. 3.

Figure 11:
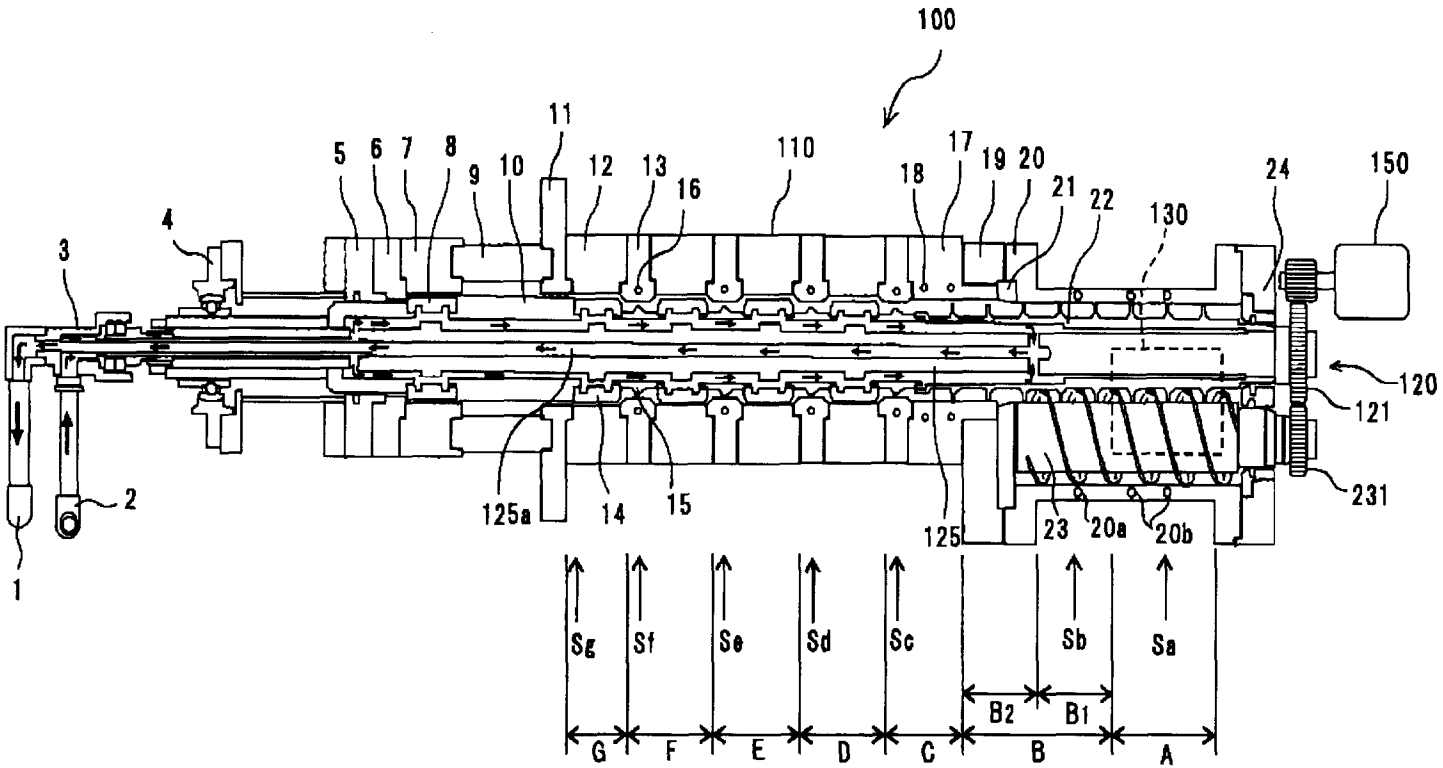
FIG. 11 is an explanatory drawing exemplarily showing the manner in which band heaters and temperature sensors are placed in a continuous kneading apparatus used in an Example.

FIG. 11 is an explanatory drawing showing the manner in which band heaters and temperature sensors are placed in the continuous kneading apparatus 100 used in the experiment. The areas A to G in FIG. 11 are areas where temperature control is independently performed, and the signs Sa to Sg denote the positions where temperature sensors for the respective areas are placed.

There is no band heater placed in the area A; when the temperature is higher than a predetermined temperature according to the result of detection performed by the upstream-side temperature sensor Sa, the flow of a cooling medium in the upstream-side cooling medium passage 20*b* is controlled so as to cool the area A.

In the area B, two band heaters having different inner diameters, which correspond to a small outer diameter area B1 and a large outer diameter area B2 of the second feed cylinder 20, are placed on the outer circumference of the second feed cylinder 20, and the flow of a cooling medium in the downstream-side cooling medium passage 20*a* and heating by the two band heaters are controlled based upon the result of detection performed by the downstream-side temperature sensor Sb so as to control the temperature of the area B.

In the area C, one band heater is placed to cover the outer circumferences of the feed liner 17 and the stationary disc 13 placed downstream of and adjacently to the feed liner 17, and the flow of a cooling medium in the feed liner cooling medium passage 18 and the stationary disc cooling medium passage 16 and heating by the band heater are controlled based upon the result of detection performed by the temperature sensor Sc so as to control the temperature of the area C.

In each of the areas D to F, one band heater is placed to cover the outer circumferences of one kneading cylinder 12 and the stationary disc 13 placed downstream of and adjacently to the kneading cylinder 12, and the flow of a cooling medium in the stationary disc cooling medium passage 16 and heating by the band heater are controlled based upon the result of detection performed by each temperature sensor (Sd to Sf) so as to control the temperature of each area (D to F).

In the area G, one band heater is placed to cover the outer circumference of one kneading cylinder 12; when the temperature is lower than a predetermined temperature according to the result of detection performed by the temperature sensor Sg, heating by the band heater is controlled so as to heat the area G.

FIG. 11 is an explanatory drawing of the continuous kneading apparatus 100 corresponding to Example 5; in the case of Example 4, the direction of the flow of the cooling medium passing through the drive shaft cooling medium passage 125*a* is opposite to that in the structure shown in FIG. 11. With the condition of "one pair" regarding "placement of stationary disc" and "placement of rotary disc member" as in Examples 1 to 3 and 6, and Comparative Example, the areas A to D are similar to those of the continuous kneading apparatus 100 shown in FIG. 11, and the outlet flange 11 is placed without the areas E to G being provided downstream of the area D.

The term "minimum clearance" in Table 1 refers to the minimum clearance d between the stationary disc 13 and the rotary disc member 14. Also, there is no difference in "amount of material supplied" among Examples and Comparative Example: the powder raw materials are continuously inserted from the supply port 130 at a rate of 10 kg per hour. The term "number of revolutions of rotary portion" refers to the number of revolutions of the rotary portion 120 composed of the drive shaft member 125, the rotary disc members 14 and the screw members 15 fixed to the drive shaft member 125, etc.

The term "temp. of second feed cylinder" refers to the set temperature of the second feed cylinder 20 constituting the raw material supply portion. A cooling mechanism (the flow of a cooling medium) and a heating mechanism (band heater), which are not shown, are controlled based upon the result of detection performed by the downstream-side temperature sensor Sb placed in the second feed cylinder 20, and temperature control is performed such that the temperature at the place where the downstream-side temperature sensor Sb is placed stands at 60° C.

The terms "temp. of first stationary disc", "temp. of second stationary disc" and "temp. of third and fourth stationary discs" refer to the set temperatures of the respective stationary discs 13. The flow of a cooling medium in the stationary disc cooling medium passage 16 and the band heaters are controlled based upon the result of detection performed by temperature sensors (not shown) placed on the respective stationary discs 13, and temperature control is performed such that the temperatures at the places where the respective temperature sensors are placed stand at 60° C.

Regarding the temperatures of the first to fourth stationary discs, in the case where the stationary disc 13 is placed in four places with respect to the axis direction in a structure similar to that of the continuous kneading apparatus 100 of the above embodiment as in Examples 4 and 5, the set temperature of the stationary disc 13 on the most downstream side (farthest left-hand side in FIG. 1) with respect to the conveyance direction is defined as "temp. of first stationary disc", and the set temperatures of the stationary discs 13 situated upstream of the foregoing stationary disc 13 are defined as the temperatures of the second to fourth stationary discs, respectively.

With regard to FIG. 11, the temperature detected by the temperature sensor Sf placed in the area F is defined as "temp. of first stationary disc", and the temperature detected by the temperature sensor Sc placed in the area C is defined as "temp. of fourth stationary disc".

Meanwhile, regarding the structure in which one rotary disc member 14 is sandwiched between two stationary discs 13 with respect to the axis direction as in Examples 1 to 3 and 6, and Comparative Example, the set temperature of the stationary disc 13 situated downstream of the rotary disc member 14 with respect to the conveyance direction is defined as "temp. of first stationary disc", and the set temperature of the stationary disc 13 situated upstream of the rotary disc member 14 with respect to the conveyance direction is defined as "temp. of second stationary disc". In other words, in a structure without the areas E to G shown in FIG. 11, the temperature detected by the temperature sensor Sd placed in the area D is defined as "temp. of first stationary disc", and the temperature detected by the temperature sensor Sc placed in the area C is defined as "temp. of second stationary disc".

The term "temp. of cooling medium at rotary portion" refers to a predetermined temperature to which the temperature of a cooling medium circulating in the rotary disc member 14, the screw member 15 and the drive shaft member 125 of the rotary portion 120 is adjusted by a cooling medium temperature adjustor (cooling medium temperature adjusting unit) not shown, and the temperature of the cooling medium sent from the cooling medium temperature adjustor to the rotary portion 120 is adjusted to 60° C.

The term "direction of flow of cooling medium at rotary portion" refers to a flow condition of a cooling medium as to whether the cooling medium sent from the cooling medium temperature adjustor to the rotary portion 120 passes through the drive shaft cooling medium passage 125*a* first or it passes through the rotary disc cooling medium passage 14*a* and the screw cooling medium passage 15*a* and then passes through the drive shaft cooling medium passage 125*a*. The structure in which the cooling medium sent from the cooling medium temperature adjustor to the rotary portion 120 passes through the drive shaft cooling medium passage 125*a*, then passes through the rotary disc cooling medium passage 14*a* and the screw cooling medium passage 15*a* and subsequently returns to the cooling medium temperature adjustor is denoted by the term "from inside to outside", whereas the structure in which it passes through the rotary disc cooling medium passage 14*a* and the screw cooling medium passage 15*a*, then passes through the drive shaft cooling medium passage 125*a* and subsequently returns to the cooling medium temperature adjustor is denoted by the term "from outside to inside". The continuous kneading apparatus 100 of the embodiment explained referring to FIG. 1, etc. employs "from outside to inside" as the condition of the flow of the cooling medium; accordingly, Example 5, in which "four places" is employed as the condition for "placement of stationary disc" and "placement of rotary disc member" and "from outside to inside" is employed as the condition of the flow of the cooling medium, corresponds to the continuous kneading apparatus 100 of the embodiment described above.

Note that since Comparative Example employs a structure in which a cooling medium does not pass through the rotary portion 120, blank spaces are left for "temp. of cooling medium at rotary portion" and "direction of flow of cooling medium at rotary portion".

Evaluation of Dispersion of Wax

Sections of the kneaded resulting products produced by means of the continuous kneading apparatuses with the conditions shown in Table 1 were obtained using a microtome, and photographing was carried out at 30 fields of view (places) using a transmission electron microscope (at a magnification of 10,000 times). Wax dispersion particles were extracted regarding each photograph, the average value of the major axes and minor axes thereof was defined as the wax particle diameter, and the wax average particle diameter regarding each image was calculated. Thereafter, the average particle diameter with respect to 30 images was calculated, and the obtained wax dispersion diameter was evaluated. Evaluation data and evaluation ranks are shown in Table 2. Also, the equivalence between the evaluation data and the evaluation ranks is shown in Table 3.

TABLE 2

| | Evaluation data | Evaluation rank |
|---|---|---|
| Example 1 | 1.73 (μm) | 6 |
| Example 2 | 1.65 (μm) | 6 |
| Example 3 | 1.50 (μm) | 7 |
| Example 4 | 1.05 (μm) | 9 |
| Example 5 | 0.91 (μm) | 10 |
| Example 6 | 1.25 (μm) | 8 |
| Comparative Example | 2.93 (μm) | 1 |

TABLE 3

| Evaluation rank | Evaluation data |
|---|---|
| Rank 1 | 2.60 or greater (μm) |
| Rank 2 | 2.40 to 2.59 (μm) |
| Rank 3 | 2.20 to 2.39 (μm) |
| Rank 4 | 2.00 to 2.19 (μm) |
| Rank 5 | 1.80 to 1.99 (μm) |
| Rank 6 | 1.60 to 1.79 (μm) |
| Rank 7 | 1.40 to 1.59 (μm) |
| Rank 8 | 1.20 to 1.39 (μm) |
| Rank 9 | 1.00 to 1.19 (μm) |
| Rank 10 | less than 1.00 (μm) |

Evaluation of Operational Stability

While the apparatus was in continuous operation for 10 hours, the number of times the apparatus halted, which stemmed from backflow of the raw materials from the supply port 130, discharge failure, etc., was measured to thereby evaluate the continuous stability. Evaluation data and evaluation ranks are shown in Table 4. Also, the correspondence between the evaluation data and the evaluation ranks is shown in Table 5.

TABLE 4

| | Evaluation data | Evaluation rank |
|---|---|---|
| Example 1 | 7 times | 3 |
| Example 2 | 2 times | 8 |
| Example 3 | 2 times | 8 |
| Example 4 | 0 times | 10 |
| Example 5 | 0 times | 10 |
| Example 6 | 0 times | 10 |
| Comparative Example | 7 times | 3 |

TABLE 5

| Evaluation rank | Evaluation data |
|---|---|
| Rank 1 | nine times or more |
| Rank 2 | eight times |
| Rank 3 | seven times |
| Rank 4 | six times |
| Rank 5 | five times |
| Rank 6 | four times |
| Rank 7 | three times |
| Rank 8 | twice |
| Rank 9 | once |
| Rank 10 | zero times |

Evaluation of Durability Against Image Forming Apparatus

Each of the electrostatic image developing toners obtained in Examples and Comparative Example was installed in IPSIO SP C411 (manufactured by Ricoh Company, Ltd.), then images each containing 5% of a cyan solid portion were printed, and the number of abnormal images formed, which stemmed from smearing of a developing sleeve caused by the wax, was evaluated. Evaluation data and evaluation ranks are shown in Table 6. Also, the correspondence between the evaluation data and the evaluation ranks is shown in Table 7.

TABLE 6

| | Evaluation data | Evaluation rank |
|---|---|---|
| Example 1 | 12,556 (number) | 6 |
| Example 2 | 13,020 (number) | 6 |
| Example 3 | 14,853 (number) | 7 |
| Example 4 | 19,035 (number) | 9 |

TABLE 6-continued

| | Evaluation data | Evaluation rank |
|---|---|---|
| Example 5 | 23,231 (number) | 10 |
| Example 6 | 17,002 (number) | 8 |
| Comparative Example | 3,752 (number) | 1 |

TABLE 7

| Evaluation rank | Evaluation data |
|---|---|
| Rank 1 | less than 3,999 (number) |
| Rank 2 | 4,000 to 5,999 (number) |
| Rank 3 | 6,000 to 7,999 (number) |
| Rank 4 | 8,000 to 9,999 (number) |
| Rank 5 | 10,000 to 11,999 (number) |
| Rank 6 | 12,000 to 13,999 (number) |
| Rank 7 | 14,000 to 15,999 (number) |
| Rank 8 | 16,000 to 17,999 (number) |
| Rank 9 | 18,000 to 19,999 (number) |
| Rank 10 | 20,000 or greater (number) |

The continuous kneading apparatus 100 of the present embodiment has a structure in which while the matter to be kneaded that is present in the internal space of the cylindrical stationary portion 110 is conveyed in the rotational axis direction by rotating the drive shaft member 125 to which the rotary disc member 14 and the screw member 15 are fixed, the passing matter is continuously kneaded by providing shear force in the area where the internal wall of the stationary portion 110 and the surface of the rotary disc member 14 face each other. The screw cooling medium passage 15*a*, through which a cooling medium lower in temperature than the mater passing in the internal space passes, is provided for the screw member 15 placed upstream of the rotary disc member 14 with respect to the conveyance direction of the matter; thus. the screw member 15 which comes into contact with the matter on the upstream side of the kneading area (where the passing matter is continuously kneaded by means of shear force) can be cooled by the cooling medium in the screw cooling medium passage 15*a*. Hence, it is possible to sufficiently lower the temperature of the matter before it is kneaded, and so it is possible to efficiently cool the matter and thereby apply adequate shear force to the matter.

Also, in the continuous kneading apparatus 100, the rotary disc opposed surface 14*b* that is the circular surface of the rotary disc member 14 and the stationary disc opposed surface 13*b* that is the surface of the internal wall of the stationary portion faced by the rotary disc opposed surface 14*b* have mountain-valley configurations, i.e., concavo-convex shapes, with which to apply shear force to the matter to be kneaded that passes through the gap between these surfaces. Thus, it is possible to apply adequate shear force to the matter.

Also, in the continuous kneading apparatus 100, the stationary portion 110 has the annular stationary disc 13 which forms the internal wall surface facing the rotary disc opposed surface 14*b* that is the circular surface of the rotary disc member 14, and the stationary disc 13 is fixed to the kneading cylinder 12. By the formation of the stationary disc 13 and the kneading cylinder 12 in combination that are different members, it is possible to easily form the kneading portion 115 of the stationary portion 110 having a complex shape.

Also, in the continuous kneading apparatus 100, the rotary disc cooling medium passage 14*a*, through which a cooling medium passes, is provided for the rotary disc member 14, and the screw cooling medium passage 15*a* provided for the screw member 15 and the rotary disc cooling medium passage

14*a* are adjacent to each other and communicate with each other, constituting a flow path. Thus, it is possible to realize a structure for cooling the rotary portion 120 in a simple manner compared to a structure in which flow paths are individually provided.

Also, in the continuous kneading apparatus 100, the end of the internal space of the stationary portion 110 on the upstream side with respect to the conveyance direction is provided with the supply port 130 that is an insertion port through which the matter to be kneaded is inserted into the internal space, and two screws (the main screw 22 and the sub screw 23), whose rotational axes are parallel to each other, are provided as upstream-side conveyance members for conveying the matter inserted from the supply port 130 into the second feed cylinder 20, in the area where the screw member 15 provides conveyance force. Thus, it is possible to prevent backflow of the matter at the raw material supply portion.

Also, in the continuous kneading apparatus 100, the minimum clearance d between the rotary disc opposed surface 14*b* of the rotary disc member 14 and the stationary disc opposed surface 13*b* that is the surface of the internal wall of the stationary portion faced by the rotary disc opposed surface 14*b* is adjusted to the range of 0.2 mm to 5.0 mm. Thus, it is possible to dramatically increase the shear stress applied to the matter to be kneaded, while stable operation is performed without an overload on the apparatus.

Also, in the continuous kneading apparatus 100, the rotary disc member 14 is placed in a plurality of places in relation to the drive shaft member 125 with respect to the rotational axis direction, the screw member 15 provided with the screw cooling medium passage 15*a* is provided upstream of each of the rotary disc members 14, and the stationary disc 13 is provided in positions in which to face the rotary disc opposed surfaces 14*b* of the rotary disc members 14. Thus, it is easily possible to dramatically increase the shear stress applied to the matter to be kneaded, by increasing the number of the members.

Also, in the continuous kneading apparatus 100, the cooling medium temperature adjustor (not shown) that is a cooling medium temperature adjusting unit configured to adjust the temperature of a cooling medium to a predetermined temperature is provided, the cooling medium, whose temperature has been appropriately adjusted by the cooling medium temperature adjustor, passes through the screw cooling medium passage 15*a*, then passes through the drive shaft cooling medium passage 125*a* provided inside the drive shaft member 125 and subsequently returns to the cooling medium temperature adjustor. This structure makes it possible to efficiently cool the matter to be kneaded which is present at the kneading portion 115, minimizing thermal loss of the cooling medium, such as water, whose temperature has been adjusted to a desired temperature, and thus to dramatically improve the fine dispersibility of the filler(s) by kneading.

Regarding a method for producing a toner, which includes a weighing step for weighing a plurality of raw materials, including resin(s), that constitute a toner, a heating step for heating and melting the raw materials weighed in the weighing step, so as to produce a melted resin, a kneading step for kneading the melted resin, a cooling step for cooling the melted resin kneaded in the kneading step, so as to produce a solid resin, and a pulverizing step for pulverizing the solid resin so as to obtain a pulverized toner, to thereby produce an electrophotographic toner, the following is possible by kneading the melted resin with the use of the continuous kneading apparatus 100 of the present embodiment in the kneading step: it is possible to apply adequate shear force to the matter to be kneaded which includes the resin(s) and filler(s), and thus to obtain a toner in which the filler(s) is/are dispersed sufficiently finely in the resin(s) serving as a base.

What is claimed is:

1. A continuous kneading apparatus which continuously kneads matter to be kneaded, comprising:

a cylindrical stationary portion having an internal space in which the matter is conveyed;

a rotary disc member configured to convey the matter in the internal space;

a screw member configured to convey the matter in the internal space;

a drive shaft member to which the rotary disc member and the screw member are fixed;

a first cooling medium passage through which a cooling medium for cooling the matter passes, wherein the first cooling medium passage is provided for the screw member which is placed upstream of the rotary disc member with respect to the conveyance direction of the matter; and a second cooling medium passage through which the cooling medium passes, wherein the second cooling medium passage is provided for the rotary disc member;

wherein the first cooling medium passage provided for the screw member and the second cooling medium passage provided for the rotary disc member are adjacent to each other and communicate with each other, constituting a flow path, wherein the cooling medium is lower in temperature than the matter passing in the internal space, and wherein the matter passes in the internal space while provided with shear force in an area, where an internal wall of the stationary portion and a circular surface of the rotary disc member face each other, by rotation of the drive shaft member and thus continuously kneaded, and while cooled by the cooling medium.

2. The continuous kneading apparatus according to claim 1, wherein the circular surface of the rotary disc member, and a surface of the internal wall of the stationary portion, faced by the circular surface, have a concavo-convex shape to provide shear force to the matter to be kneaded which passes through a gap between these surfaces.

3. The continuous kneading apparatus according to claim 1, wherein the stationary portion includes an annular stationary disc which forms the surface of the internal wall facing the circular surface of the rotary disc member.

4. The continuous kneading apparatus according to claim 1, further comprising: an insertion port which is provided in an end of the internal space of the stationary portion on the upstream side with respect to the conveyance direction, and through which the matter to be kneaded is inserted into the internal space; and two screws, whose rotational axes are parallel to each other, as upstream-side conveyance members which convey the matter inserted from the insertion port into an area where the screw member provides conveyance force.

5. The continuous kneading apparatus according to claim 1, wherein the minimum clearance between the circular surface of the rotary disc member, and the surface of the internal wall of the stationary portion, faced by the circular surface, is in the range of 0.2 mm to 5.0 mm.

6. The continuous kneading apparatus according to claim 1, wherein the rotary disc member is placed in relation to the drive shaft member with respect to the rotational axis direction, and the screw member provided with the first cooling medium passage is placed upstream of the rotary disc member.

7. The continuous kneading apparatus according to claim 1, further comprising: a cooling medium temperature adjusting unit configured to adjust the temperature of the cooling medium to a predetermined temperature; and a third cooling medium passage provided in the drive shaft member, wherein the cooling medium, whose temperature has been adjusted by the cooling medium temperature adjusting unit, passes through the first cooling medium passage provided for the screw member, then passes through the third cooling medium passage provided in the drive shaft member, and subsequently returns to the cooling medium temperature adjusting unit.

8. The continuous kneading apparatus according to claim 1, comprising a plurality of rotary disc members, wherein the rotary disc members are placed in a plurality of places in relation to the drive shaft member with respect to the rotational axis direction, and the screw member provided with the first cooling medium passage is placed upstream of each of the rotary disc members.

* * * * *